US010639667B2

(12) United States Patent
Fuller

(10) Patent No.: US 10,639,667 B2
(45) Date of Patent: May 5, 2020

(54) TRAVELING LAMINAR STREAMS

(71) Applicant: WET, Sun Valley, CA (US)

(72) Inventor: Mark Fuller, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/214,527

(22) Filed: Mar. 14, 2014

(65) Prior Publication Data

US 2014/0312139 A1 Oct. 23, 2014

Related U.S. Application Data

(60) Provisional application No. 61/801,497, filed on Mar. 15, 2013.

(51) Int. Cl.
*B05B 17/08* (2006.01)
*B05B 13/04* (2006.01)

(52) U.S. Cl.
CPC ..... *B05B 17/08* (2013.01); *B05B 13/04* (2013.01); *B05B 13/041* (2013.01)

(58) Field of Classification Search
CPC ..... B05B 17/08; B05B 13/04; B05B 13/041; B05B 13/0415
USPC ..... 239/17–23, 743–749
See application file for complete search history.

(56) References Cited

U.S. PATENT DOCUMENTS

| | | | | |
|---|---|---|---|---|
| 3,726,478 | A * | 4/1973 | McMurray | A01G 25/097 239/724 |
| 3,907,204 | A * | 9/1975 | Przystawik | 239/242 |
| 3,908,907 | A * | 9/1975 | Beltran | B60S 3/042 239/752 |
| 4,265,404 | A * | 5/1981 | Hunter | B05B 1/083 239/747 |
| 6,651,900 | B1 * | 11/2003 | Yoshida | A62C 25/00 169/13 |
| 7,886,992 | B2 * | 2/2011 | Wiseman | B05B 15/00 239/17 |
| 2007/0181712 | A1 * | 8/2007 | Ivy | A62C 25/00 239/251 |

* cited by examiner

*Primary Examiner* — Christopher S Kim
(74) *Attorney, Agent, or Firm* — Maceiko IP

(57) ABSTRACT

A water display is described whereby parabolic water streams may be controlled so as to appear to move towards or away from each other or step over each other.

11 Claims, 16 Drawing Sheets

TRAVELING LAMINAR STREAMS

CROSS REFERENCE TO RELATED APPLICATION

The application claims the benefit of U.S. Provisional Application No. 61/801,497, filed Mar. 15, 2013, the contents of which are incorporated herein by reference.

FIELD OF THE INVENTION

The present invention generally relates to water displays, including water delivery devices that provide streams of water that may appear to jump over one another.

BACKGROUND OF THE INVENTION

Various types of water displays exist, and many of them include water delivery devices that shoot water into the air. Oftentimes, the water display is located in a reservoir having a floor and walls. Before the reservoir is filled with water, the water delivery devices may be attached to the bottom of the reservoir or to other hardware. After the reservoir is filled, water generally surrounds the water delivery devices, but the outlet of the water delivery device typically remains above the reservoir water level.

These existing water delivery devices may provide dramatic visual effects, but if they are fixed to the bottom of the water reservoir, there is some limitation of the visual effects they can produce. For example, fixed water delivery devices typically cannot provide the appearance of a stream of water that moves to different locations in the reservoir.

Furthermore, the water streams provided by these water delivery devices typically do not provide the appearance that they can jump over one another. This is largely because this would typically require the water delivery device to move past another water delivery device which cannot happen if they are on the same track.

Accordingly, there is a need for water delivery devices that may provide the appearance that the water one of the devices shoots into the air jumps over the water stream shot out of the other water delivery device.

SUMMARY OF THE INVENTION

In a first aspect of the invention, unique visual effects provided by a water display are described. To this end, the water display of the current invention may provide the appearance that water streams chase each other, jump over each other and continue moving.

In another aspect of the invention, a system is described which includes two or more water delivery devices which include nozzles that shoot out water in laminar flow. The water delivery devices may travel along a track located below the visible portion of the water display. The water delivery devices may include stream interrupters so that the pattern of water shot out of the water delivery devices may be stopped and otherwise controlled. The track may be located under a slit in the floor of the water display. The slit may be slightly wider than the stream diameter.

In another aspect of the invention, programming of the streams may give the appearance that one laminar stream is chasing another, jumping over it, and continuing on across the floor. The resulting fountain may provide dramatic visual effects

DETAILED DESCRIPTION OF THE PREFERRED EMBODIMENTS

Figure 1:
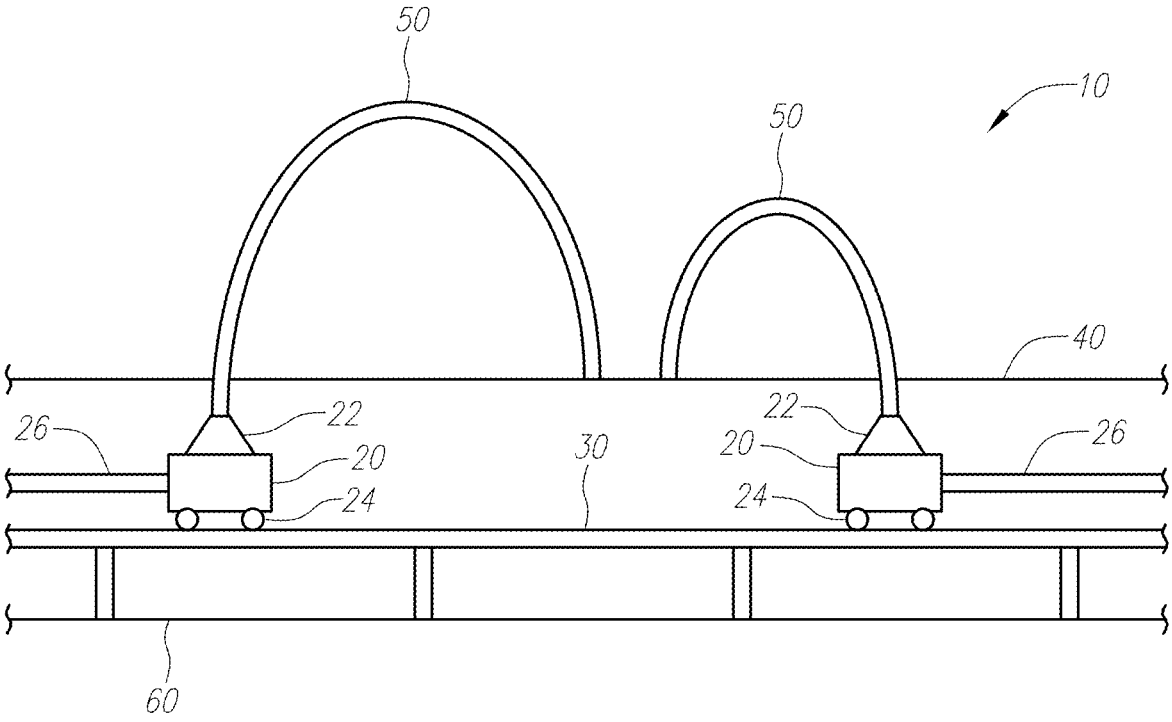
FIG. 1 is a side view of water shooters mounted on tracks emitting laminar parabolic water streams.

The current invention is now described with reference to the figures. Components appearing in more than one figure bear the same reference numerals. While the current invention is described in connection with water, it should be noted that other fluids or combinations thereof may be used. Accordingly, the current invention is not limited to the use of water. The reference to water shooter herein refers to any suitable water delivery device.

A system 10 embodying the current invention is now described with reference to FIG. 1. In general, system 10 of the current invention may form part of a water display that may be housed by a pool or reservoir. The pool or reservoir may include floor 60 and walls. After pool is filled with water, pool 2 generally has a water surface.

As shown in FIG. 1, track 30 may be mounted on bottom surface 60 of the reservoir and may be configured to support water shooters 20 that may be equipped with laminar nozzles 22. Water shooters 20 may be mounted onto movable track mounts 24 that may support, align and otherwise hold water shooters 20 onto track 30 while having the ability to move along the track 30 laterally. Track 30 may generally act as a guide and as a support to the movable track mounts 24 thereby supporting and guiding water shooters 20. Movable track mounts 24 may employ wheels, bearings, or other devices that allow the mounts 24 to engage with track 30 while having the ability to travel its general length.

Figure 2:
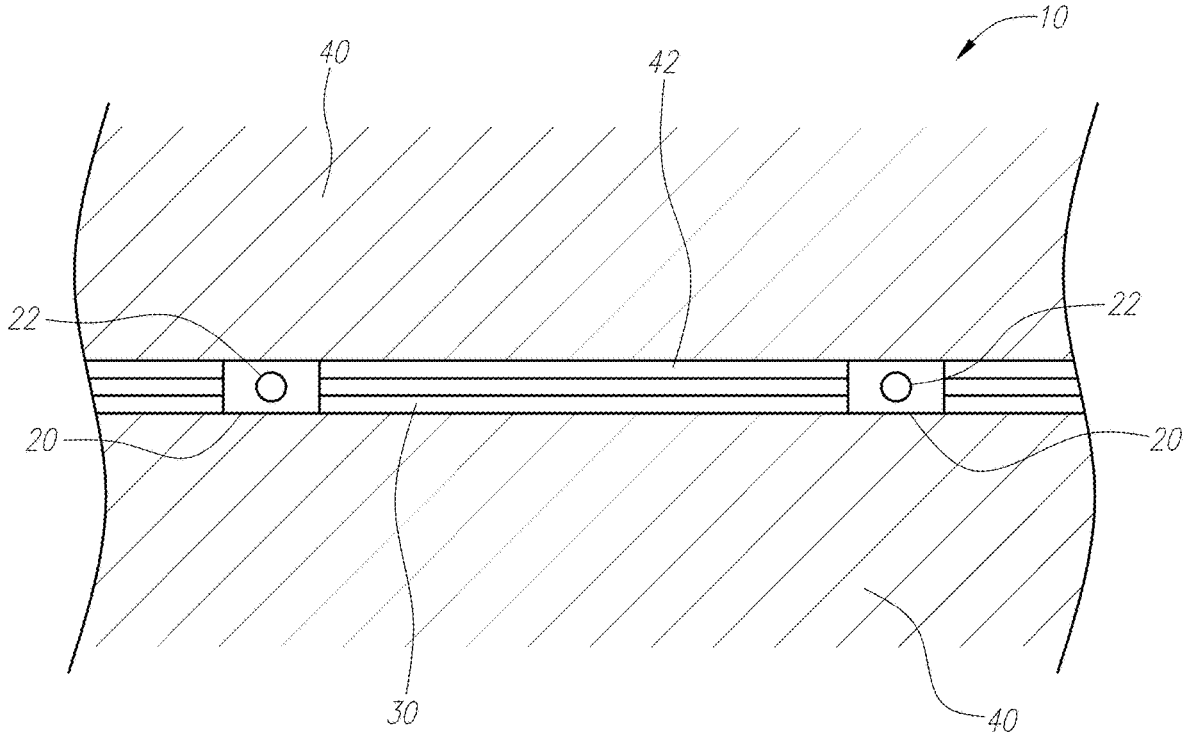
FIG. 2 is a top view of water shooters mounted on tracks beneath a slot in a top floor.

While a single track 30 is shown in FIG. 1 and FIG. 2, multiple tracks 30 may be used. Multiple tracks 30 may be generally parallel with respect to each other, or may positioned in different non-parallel configurations. In addition, while FIG. 1 and FIG. 2 depict that track 30 as being generally straight, the track 30 may be configured in a curved or other configuration and may have sections that are configured in other shapes such as curved, circular, figure-eight, or other shapes.

Water shooters 20 may include water input pipes 26 that may supply water into the water shooters 20, and output laminar nozzles 22 that may launch generally laminar streams 50 of water into the air as shown in FIG. 1. It may be preferable that the laminar nozzles 22 shoot laminar streams 50 that may have generally smooth appearances as opposed to turbulent streams. Streams 50 may be emitted by laminar nozzles 22 to parabolic trajectories resulting in parabolic water display shapes.

The output cross sections of the laminar nozzles 22 may be circular which may result in laminar streams 50 that also have circular cross sections. However, the outlet cross section of nozzles 22 may be other shapes such as oval, square, triangular or other shapes such that the cross sectional shapes of the streams 50 may be similarly configured. As discussed in later sections in further detail, the height, general shape and trajectory of the laminar streams 50 may depend on the launch angle of the laminar nozzles 22 and the water pressure of the water input into the water shooters 20 via the water input pipes 26.

Each water shooter 20 may also include a stream interrupter (not shown) that may abruptly stop the output stream 50 emitted by the laminar nozzle 22. Stream interrupters may comprise a mechanical device such as a fast-acting valve that may abruptly shut off the flow of water from the laminar nozzles 22. It is preferred that the stream interrupters be fast-acting such that the water stream may suddenly cease when the interrupter is engaged. Water that may have been already released by the nozzle 22 prior to the engagement of the interrupter however may complete it parabolic trajectory. This will be described in later sections in further detail.

In addition, system 10 may also include an upper floor 40 that may be positioned generally above the top of the laminar nozzles 22 as shown in FIG. 1. As shown in FIG. 2, upper floor 40 may have a slot 42 that may generally coincide with the length of the track 30. It may be preferable that the slot 42 have a width that may be slightly greater than the diameter of the output of the laminar nozzles 22 such that water streams 50 emitted from the output of the laminar nozzles 22 may pass through the slot 42 and into the generally free space above the upper floor 40 without being deflected or otherwise distorted by the slot 42. In addition, it may be preferable that system 10 have drainage systems located on the bottom floor 60 as well as on the upper floor 40 for proper drainage of excess water.

While FIG. 1 depicts the top of the laminar nozzles 22 as being positioned slightly below the upper floor 40, the top of the laminar nozzles 22 may be even with the upper floor 40 within the slot 42, or may slightly protrude above the upper floor 40 by protruding through the slot 42. However, it may be preferable that the top of the laminar nozzles 22 by positioned below the upper floor 40 such that they may be out of view when viewed from above the upper floor 40.

Figure 2A:
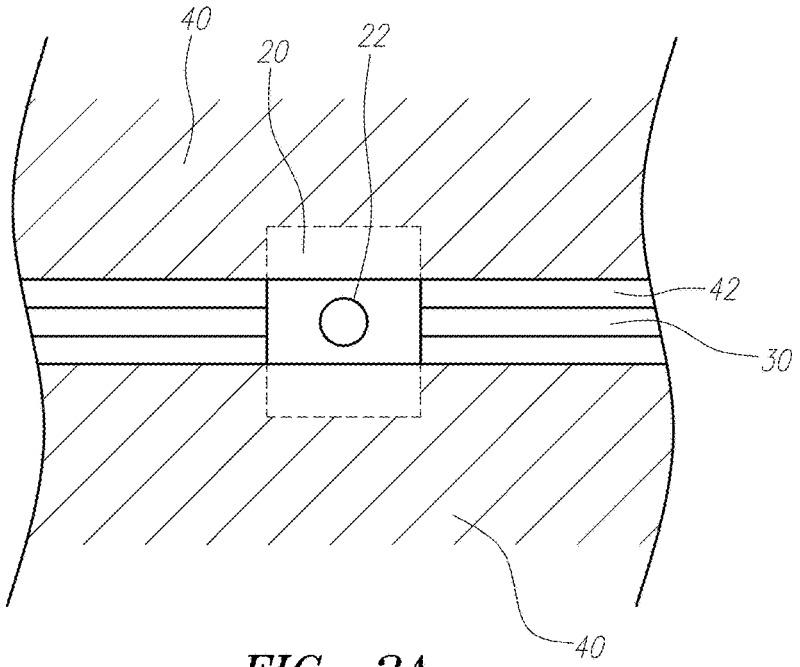
FIG. 2A is a close up top view of a water shooter mounted on a track beneath a slot in a top floor.

In addition, while FIG. 2 depicts the slot 42 as being wider than the body of the water shooters 20, the slot 42 may be thinner than the body of the water shooters 20 as depicted in FIG. 2A.

Because water shooters 20 mounted on movable track mounts 24 may travel the length of the track 30, it may be preferable that input water pipes 26 be somewhat flexible such that the pipes 26 may bend and flex as the water shooters 20 move and remain fixedly connected to the water shooters 20. It may also be preferable that the input water pipes 26 have elastic or other characteristics that may allow them to remain fixedly attached to the water shooters 20 as the shooters 20 move along the track 30.

Movable track mounts 24 may be moved along and be positioned on the track 30 through the use of a tether assembly (not shown) that may run the length of the track 30. The tether may comprise of a cable, a cord, a chain, a rope, a post, a rod or a different type of tether that may be used to position the movable track mounts 24 along the track 30. Movable track mounts 24 may also have motors that may be attached to the mounts 24 that may be used to move and position the mounts 24 along the track. In addition, the movable track mounts may be positioned along the track 30 using other means.

In a preferred embodiment, the means used to move and position the movable track mounts 24 along the track 30 may be remotely controlled using a computer or other controller. This will be described in further detail in later sections.

Figure 3:
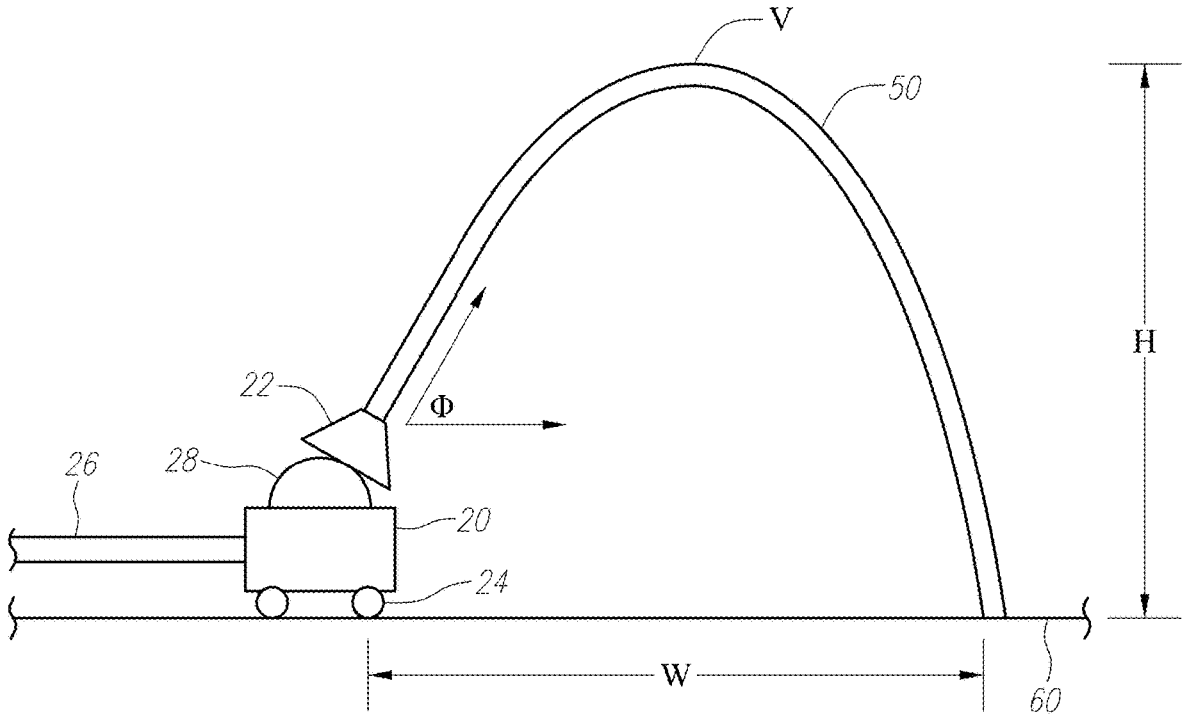
FIG. 3 is a side view of a water shooter at a launch angle emitting a parabolic water stream with a height and a width.

The laminar water streams 50 and the manner in which they may be manipulated or controlled by system 10 is now further described. As shown in FIG. 3, laminar nozzle 22 may be coupled to a water shooter 20 by a rotating mount 28 that may position the laminar nozzle 22 at different launch angles Ø. In addition, the water pressure input into the water shooter 20 through input water pipe 26 may determine the flow rate of the water out of the laminar nozzle 22.

The height H of vertex V and the width W of the generally parabolic laminar stream 50 may depend on the water pressure of the laminar stream 50 as it is emitted from the output of laminar nozzle 22 and the launch angle Ø of the laminar nozzle. For example, FIG. 3 depicts laminar nozzle 22 configured with rotating mount 28 at a launch angle of Ø which may result in the parabolic laminar stream 50 having a width W and a vertex V at a height H.

Accordingly, the interplay of the factors, i.e., (1) the water pressure input into the water shooter 20 through input water pipe 26, and (2) the launch angle Ø of the rotating mount 28 may produce the desired water display effect. For example, at a given input water flow rate, the launch angle Ø of rotating mount 28 can be adjusted to produce a particular parabolic laminar stream 50 with a particular width W and height H of vertex V, and, at a given launch angle Ø of the rotating mount 28, the input water flow rate can be adjusted to produce a particular parabolic laminar stream 50 with a particular width W and height H of vertex V. Alternatively, the input water flow rate and the launch angle Ø of rotating mount 28 can be adjusted in unison to produce a particular parabolic laminar stream.

Figure 4A:
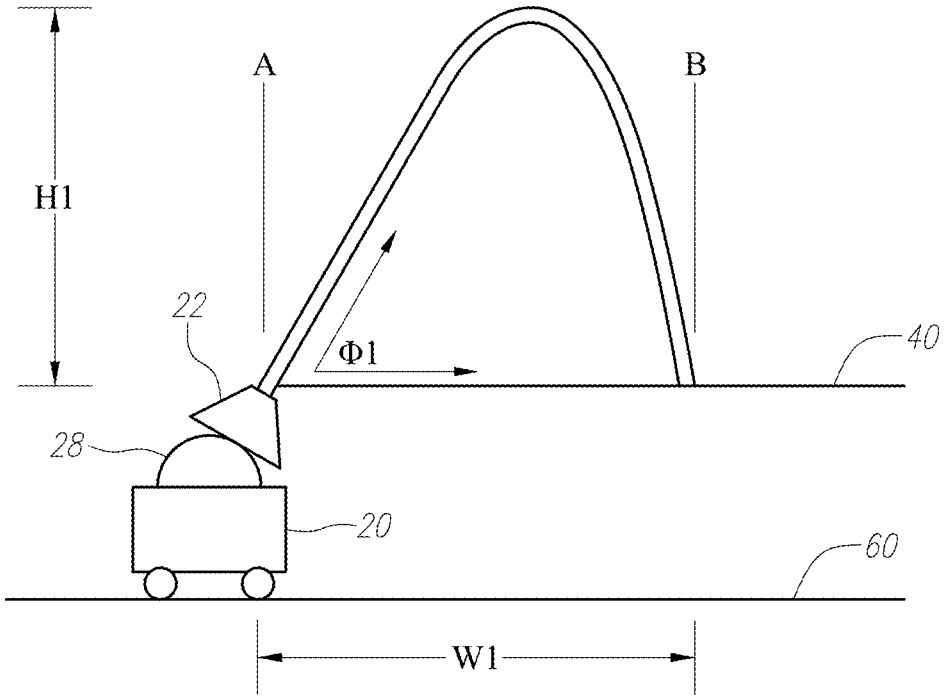
FIG. 4A is a side view of a water shooter at a launch angle Ø1 emitting a parabolic water stream with a height H1 and width W1.

The laminar water streams 50 and the manner in which they may be manipulated by system 10 to produce a particular water display and sequence that may be referred to as a "walking" sequence is now described. FIG. 4A depicts a water shooter 20 configured with a rotating mount 28 and a laminar nozzle 22 set at a launch angle of Ø1. As shown, this may result in a generally parabolic laminar water stream 50 with a height H1 and a width W1. For reference, the start point of the parabolic laminar stream 50 is shown as point A and the end point of the parabolic laminar stream is shown as point B.

Figure 4B:
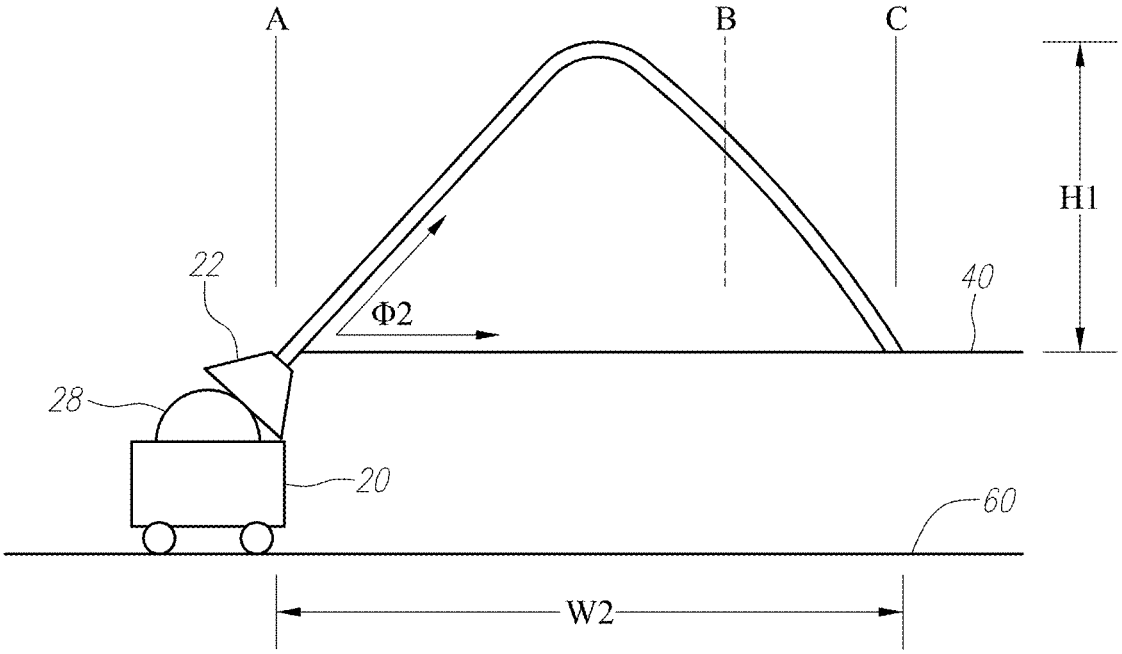
FIG. 4B is a side view of a water shooter at a launch angle Ø2 emitting a parabolic water stream with a height H2 and width W2.

In this configuration, to increase the width of the parabolic laminar stream 50 while keeping the start point A of the stream fixed and moving the end point B of the stream from point B to point C as shown in FIG. 4B, the launch angle Ø1 may be decreased from Ø1 to Ø2 as shown in FIG. 4B. It may be preferable to fix the height H1 of the parabolic laminar stream during the widening of the parabolic stream 50, and to accomplish this, the input water pressure may be gradually increased during the transition to account for the lower launch angle Ø2. This increased input water pressure may tend to increase the height of the parabolic water stream while the decreased launch angle may tend to decrease the height, such that the change of these settings in unison may tend to keep the height constant. This sequence may be referred to as the first half of a forward step of the walking sequence.

Figure 5:
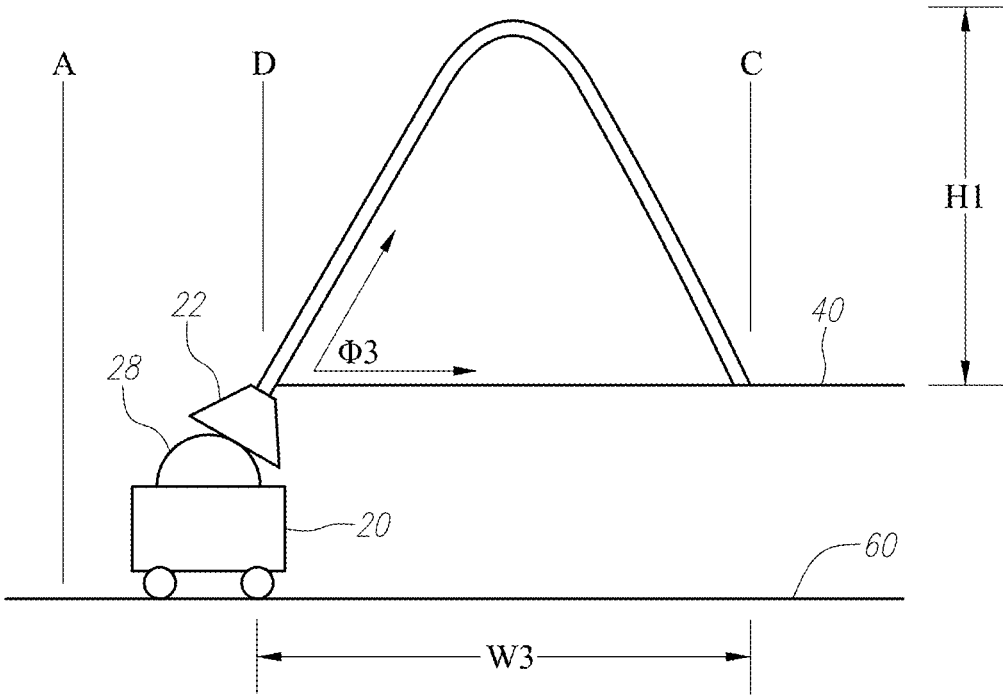
FIG. 5 is a side view of a water shooter at a launch angle Ø3 emitting a parabolic water stream with a height H3 and width W3.

The second half of a forward step of the walking sequence is now described with reference to FIG. 4B and FIG. 5. To decrease the width of the parabolic laminar stream 50 of FIG. 4B, while keeping the end point B of the stream fixed and moving the start point A of the steam from point A to point D as shown in FIG. 5, the position of the water shooter 20 may be moved along track 60 from point A to point D. During this transition, in order to keep the end point B of the parabolic stream 50 generally fixed, the launch angle Ø2 may be gradually increased to Ø3.

It may be preferable to fix the height H1 of the parabolic laminar stream during the decreasing of the width of the parabolic stream 50, and to accomplish this, the input water pressure may be gradually decreased during the transition to account for the higher launch angle Ø3. This decreased input water pressure may tend to decrease the height of the parabolic water stream 50 while the increased launch angle may tend to increase the height, such that the change of these settings in unison may tend to keep the height constant. This sequence may be referred to as the second half of a forward step of the walking sequence.

Combining the first half of a forward step and the second step of the walking sequence as described above may result in a complete forward step of the parabolic laminar water stream. In summary, a complete step of the walking sequence may first involve the end point of the parabolic steam to gradually move forward while the start point and the height of the stream remain fixed. This may emulate a forward step of one leg of the stream. The start point of the stream may then gradually move forward in the direction of the end point while the end point and the height of the stream remain fixed. This may emulate a forward step of the second leg of a stream. Performed in succession, this sequence may emulate a complete forward step of the parabolic laminar stream.

It may be desired that the parabolic stream complete several complete forward steps in a particular direction, and to accomplish this, the system 10 may repeat the described walking sequence several times in succession. It may also be desired that the parabolic stream step in the reverse direction, and to accomplish this, the system 10 may perform the steps of the forward step sequence in reverse order.

Figure 6A:
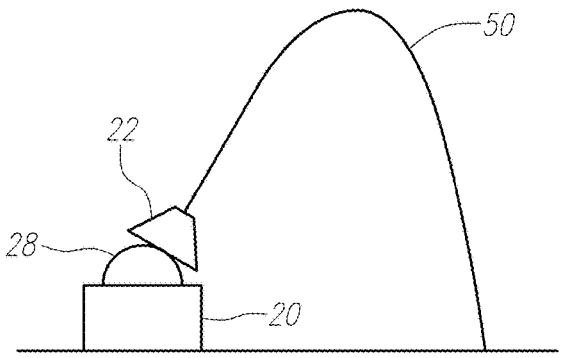
FIG. 6A is a side view of a water shooter emitting a parabolic water stream in continuous motion.

The laminar water streams 50 and the manner in which they may be controlled by system 10 to produce a particular water display, and a sequence that may be referred to as the "stepping over one another" sequence is now described. FIG. 6A depicts a water shooter 20 configured with a laminar nozzle 22 and a stream interrupter (not shown) launching a generally parabolic laminar stream 50 in continuous operation. That is, the stream emits from the laminar nozzle 22 and follows a generally parabolic trajectory such that the laminar stream 50 is generally stable and continuous.

The stream interrupter and the manner in which it may affect the parabolic water stream 50 is now described. As discussed in earlier sections, the stream interrupter may comprise of a mechanical device such as a fast-acting valve that may abruptly shut off the flow of water from the laminar nozzles 22. It may be preferable that the stream interrupters be fast-acting such that the water stream may suddenly cease when the interrupter is engaged. Water that may have been already released by the nozzle 22 prior to the engagement of the interrupter however may complete it parabolic trajectory.

Figure 6B:
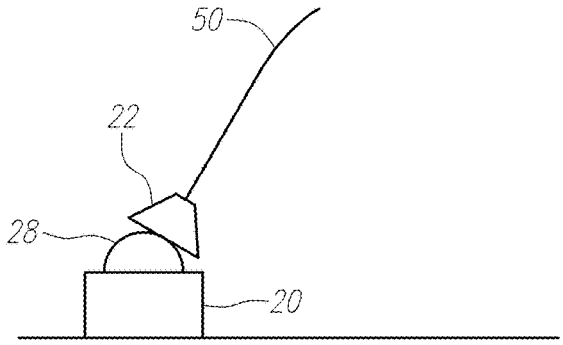
FIG. 6B is a side view of a water shooter emitting a partial parabolic water stream.
Figure 6C:
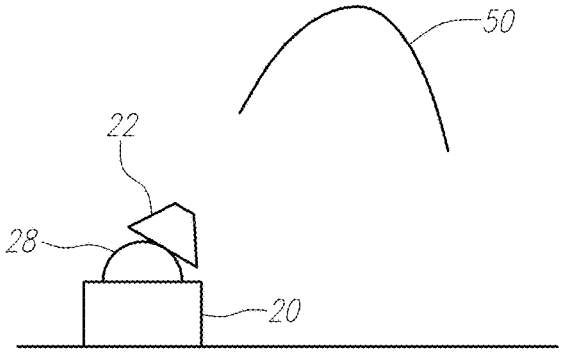
FIG. 6C is a side view of a water shooter emitting a partial parabolic water stream.
Figure 6D:
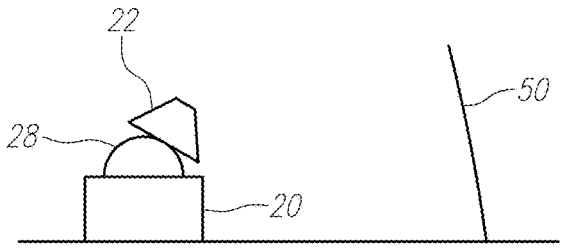
FIG. 6D is a side view of a water shooter emitting a partial parabolic water stream.

For example, FIG. 6B depicts a water shooter 20 a brief moment of time after the stream interrupter has opened such that the resulting parabolic water stream 50 has been launched into the air but has not yet completed its entire parabolic trajectory. If the stream interrupter was to be turned off abruptly at this moment in time depicted in FIG. 6B, the water that had already been launched by water shooter 20 prior to the shut off of the stream interrupter may continue on its parabolic trajectory while no other water may be launched. This is depicted in FIG. 6C. As more time passes, the water stream may continue its trajectory until it reaches its end point as shown in FIG. 6D. As more time passes, all of the water may reach its end point and the water stream may disappear.

Figure 7A:
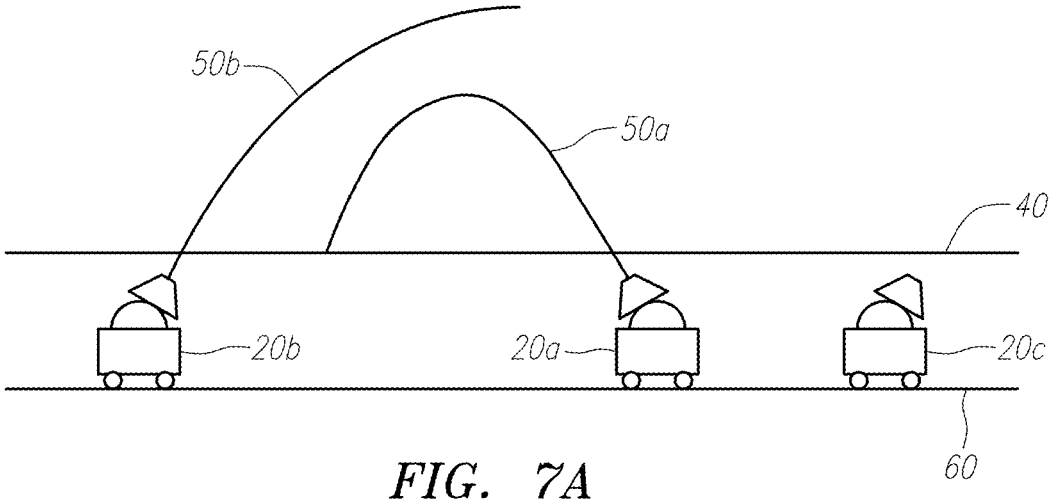
FIG. 7A is a side view of three water shooters on tracks, one shooter emitting an upper partial parabolic water stream, one shooter emitting a lower continuous parabolic water stream and one shooter emitting no water stream.

Referring back to the "stepping over one another" sequence, FIG. 7A depicts water shooter 20*a* shooting a generally parabolic water stream 50*a* in continuous operation with water shooter 20*b* at a moment in time just after its stream interrupter (not shown) may have opened such that its output water stream 50*b* may have launched but may not have yet completed it full parabolic trajectory. Water stream 50*b* may be positioned such that its parabolic trajectory may extend above the parabolic trajectory of stream 50*a* having a height and width that are greater than the height and width of water stream 50*a*.

To accomplish this, the input water pressure to water shooter 50*b* may be stronger than the input water pressure to water shooter 50*a*. In addition, the launch angle of water shooter 20*b* may be greater than the launch angle of water shooter 20*a*. As water stream 50*b* emits from water shooter 20*b*, it may begin to travel over water stream 50*a* as depicted in FIG. 7A and this motion may emulate water stream 50*b* as beginning its step over water stream 50*a*.

Figure 7B:
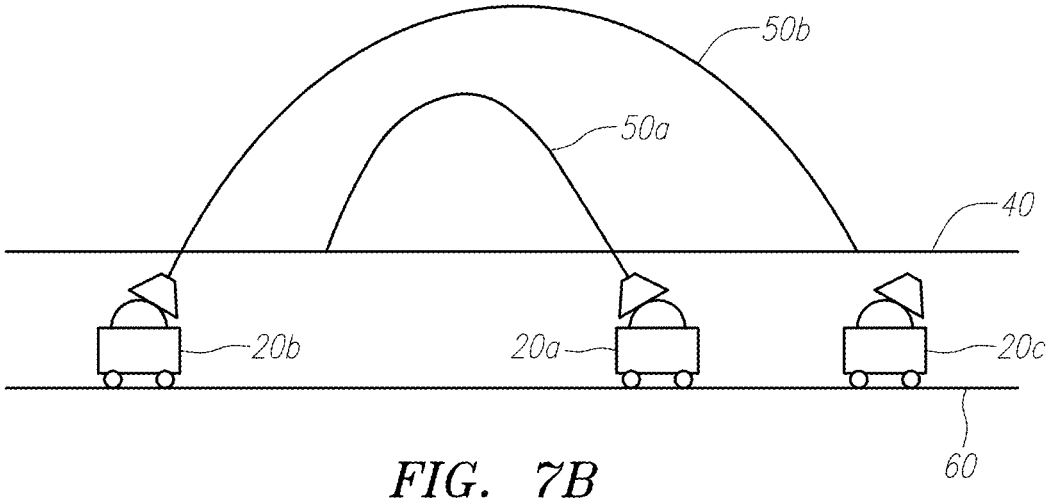
FIG. 7B is a side view of three water shooters on tracks, one emitting an upper continuous parabolic water stream, one shooter emitting a lower continuous parabolic water stream and one water shooter emitting no water stream.

As time passes, water stream 50*b* may complete its parabolic trajectory as shown in FIG. 7B. As shown, it may be preferable that the width and height of the parabolic trajectory of water stream 50*b* be greater than the width and height of water stream 50*a*. This may emulate water stream 50*b* as having completed the first half of a step over water stream 50*a*.

It should be mentioned that water shooter 20*c* may be positioned near the end point of water stream 50*b* with water shooter 20*c* having its stream interrupter engaged such that no water may emit from water shooter 20*c*. The purpose of water shooter 20*c* will be described shortly.

Figure 7C:
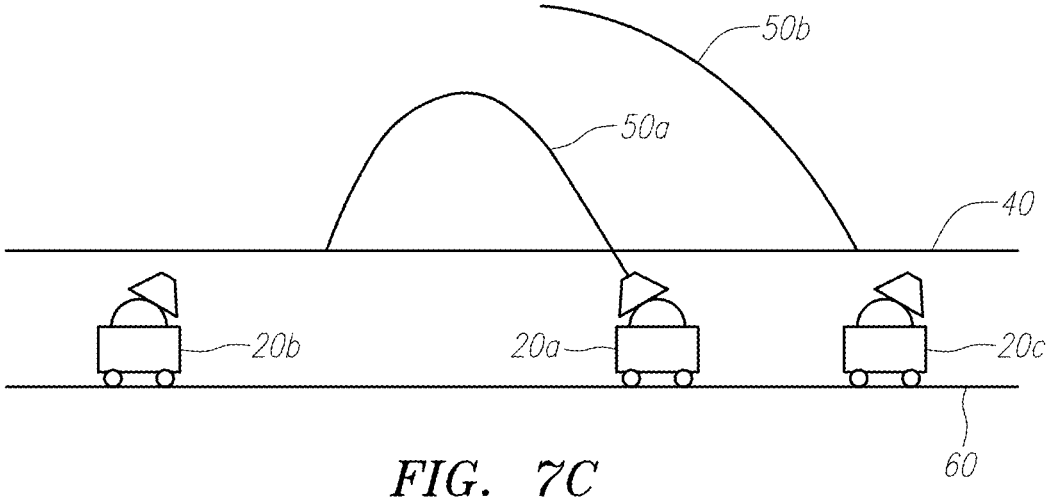
FIG. 7C is a side view of three water shooters on tracks, one shooter emitting an upper partial parabolic water stream, one shooter emitting a lower continuous parabolic water stream and one shooter emitting no water stream.
Figure 7D:
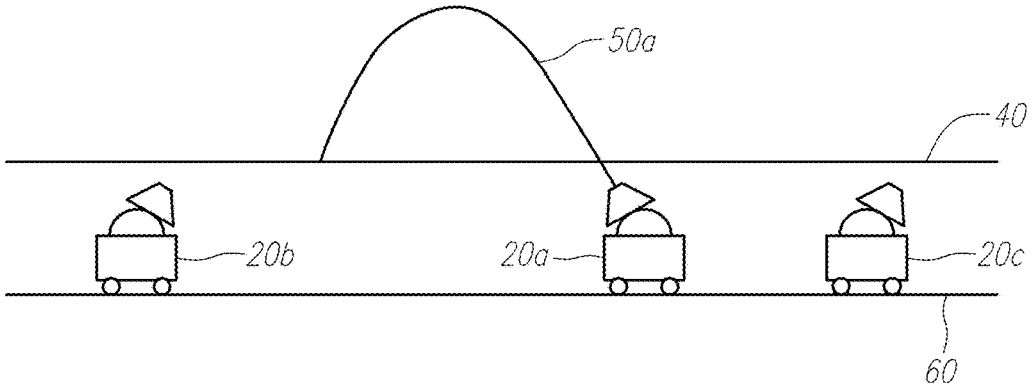
FIG. 7D is a side view of three water shooters on tracks, one shooter emitting a lower continuous parabolic water stream and two shooters emitting no water stream.

As shown in FIG. 7C, the stream interrupter (not shown) of water shooter 20*b* may engage and abruptly stop the steam 50*b* from emitting from water shooter 20*b*. The water that may have already been released by water shooter 20*b* prior to the engagement of the stream interrupter may continue to travel along its parabolic trajectory to the other side of the water stream 50*a* while no further water is emitted. Once all of the water in stream 50*b* that had been released prior to the engagement of the stream interrupter of water shooter 20*b* has completed its parabolic trajectory, stream 50*b* may disappear and no water may be present. This may complete the second half of the water stream 50*b* stepping over water stream 50*a*.

Figure 7E:
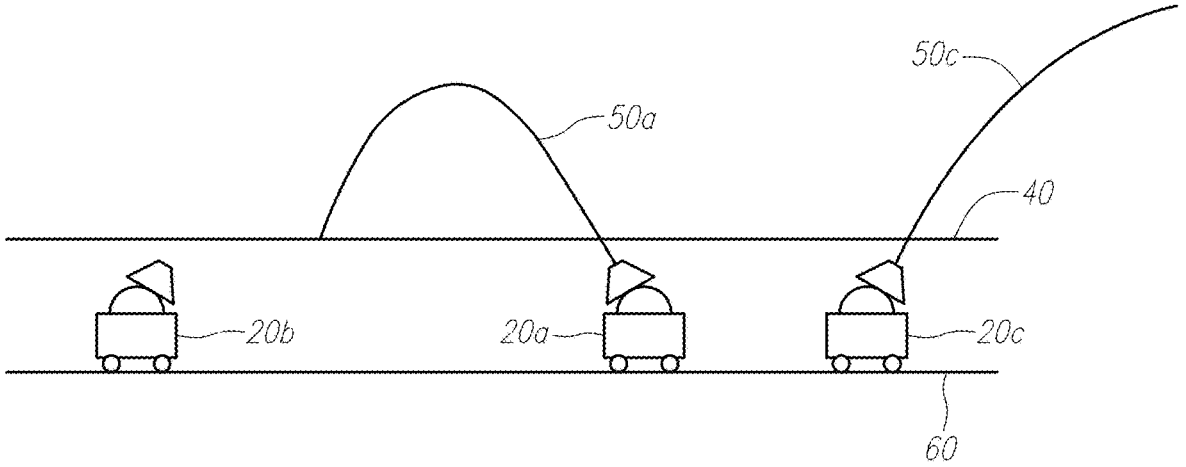
FIG. 7E is a side view of three water shooters on tracks, one shooter emitting no water stream, one shooter emitting a lower continuous parabolic water stream and one shooter emitting a side partial parabolic water stream.
Figure 8A:
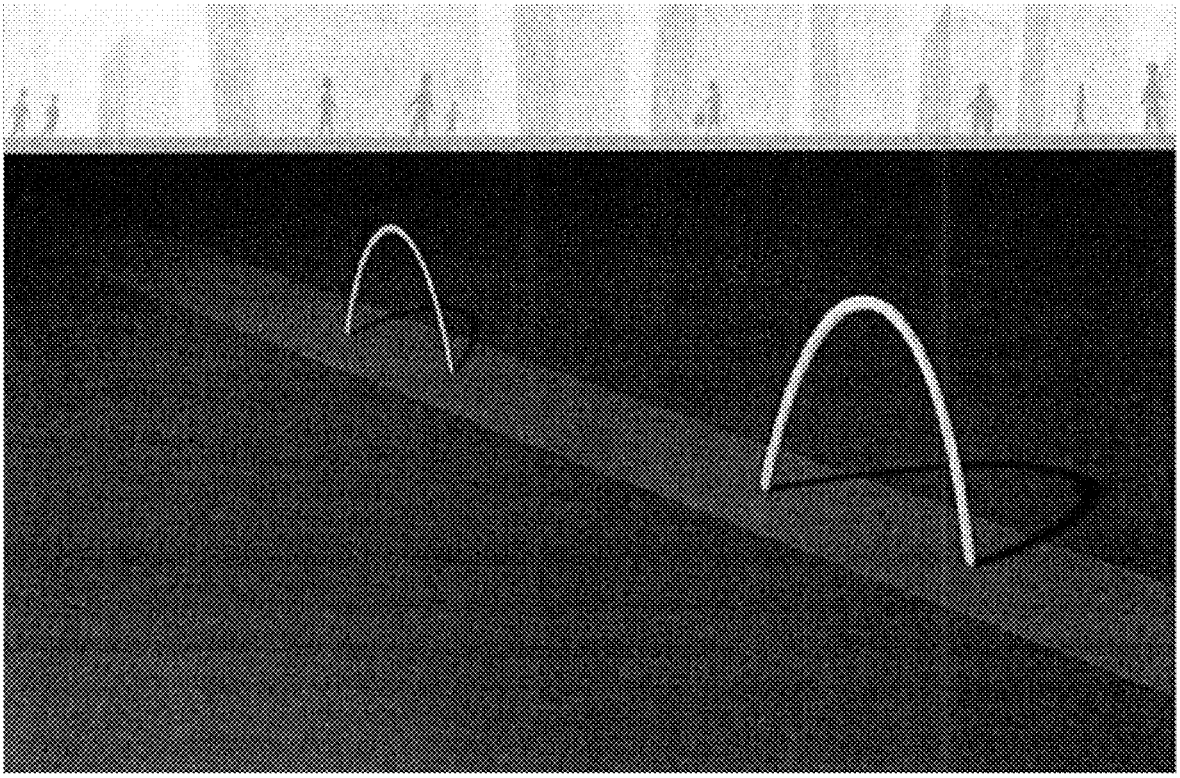
FIGS. 8A-8D show two parabolic water streams appearing to walk toward each other.
Figure 8B:
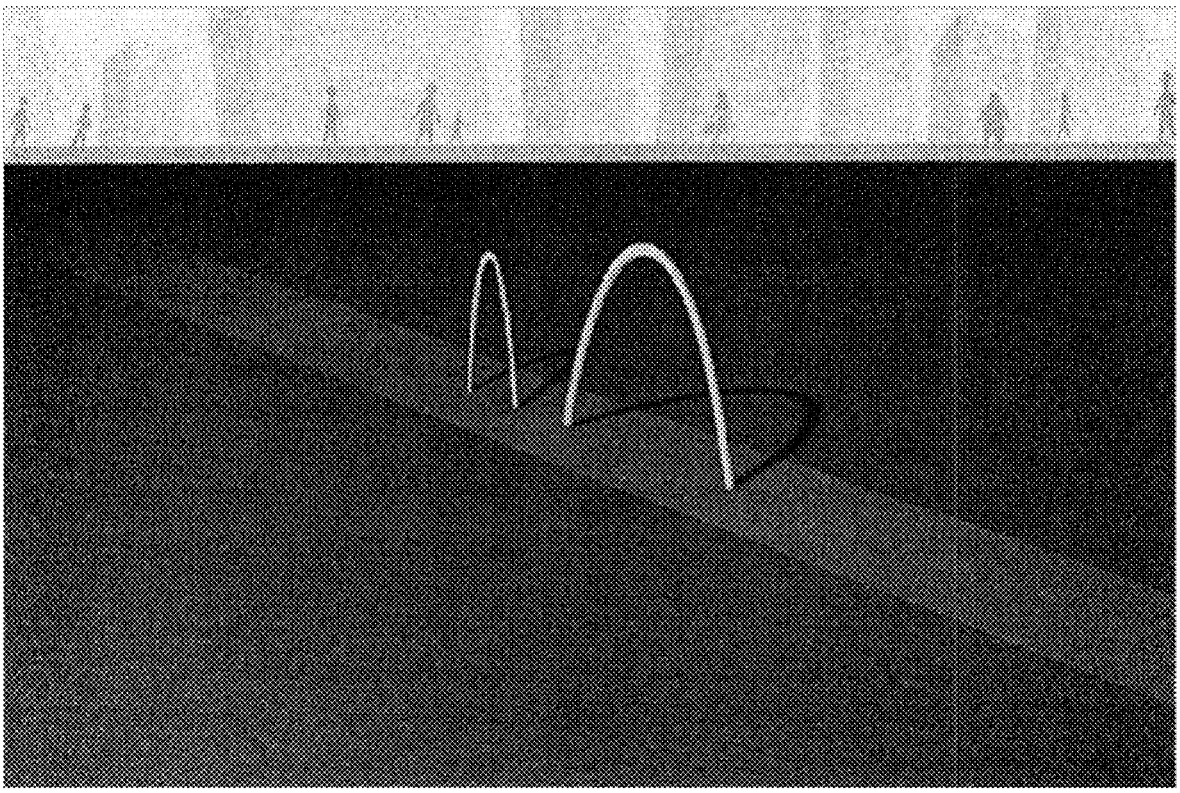
Figure 8C:
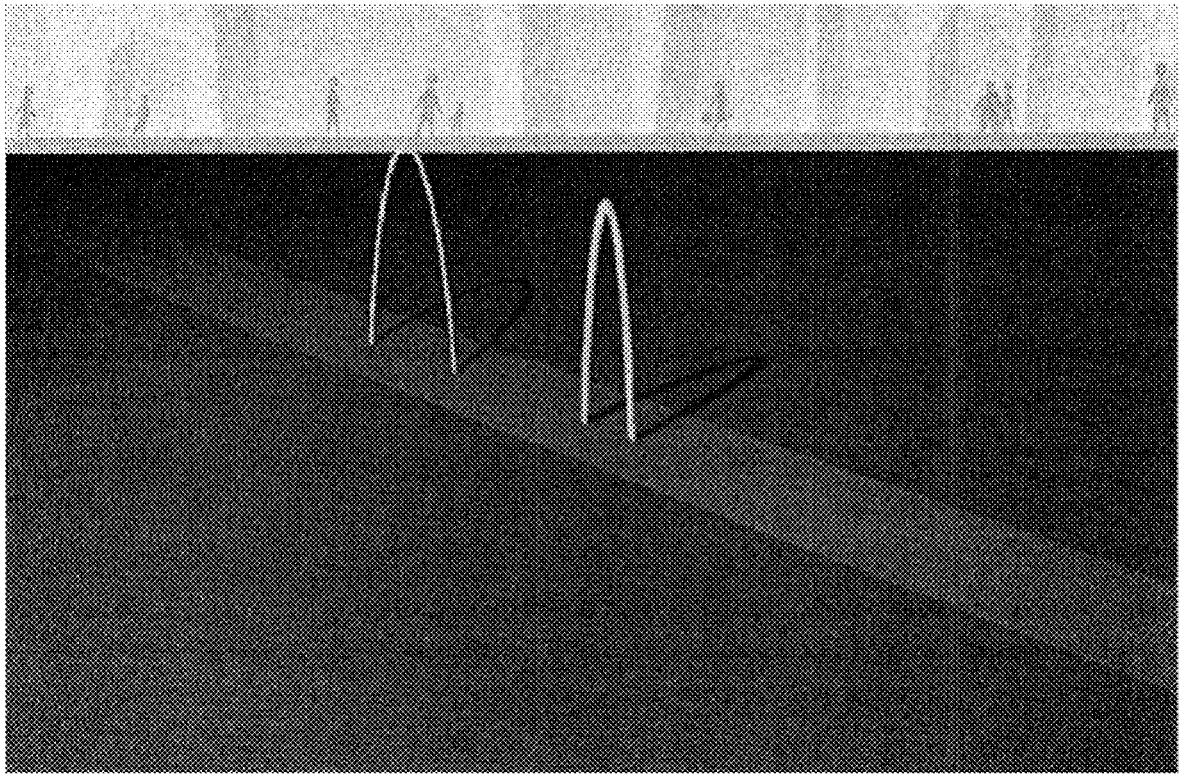
Figure 8D:
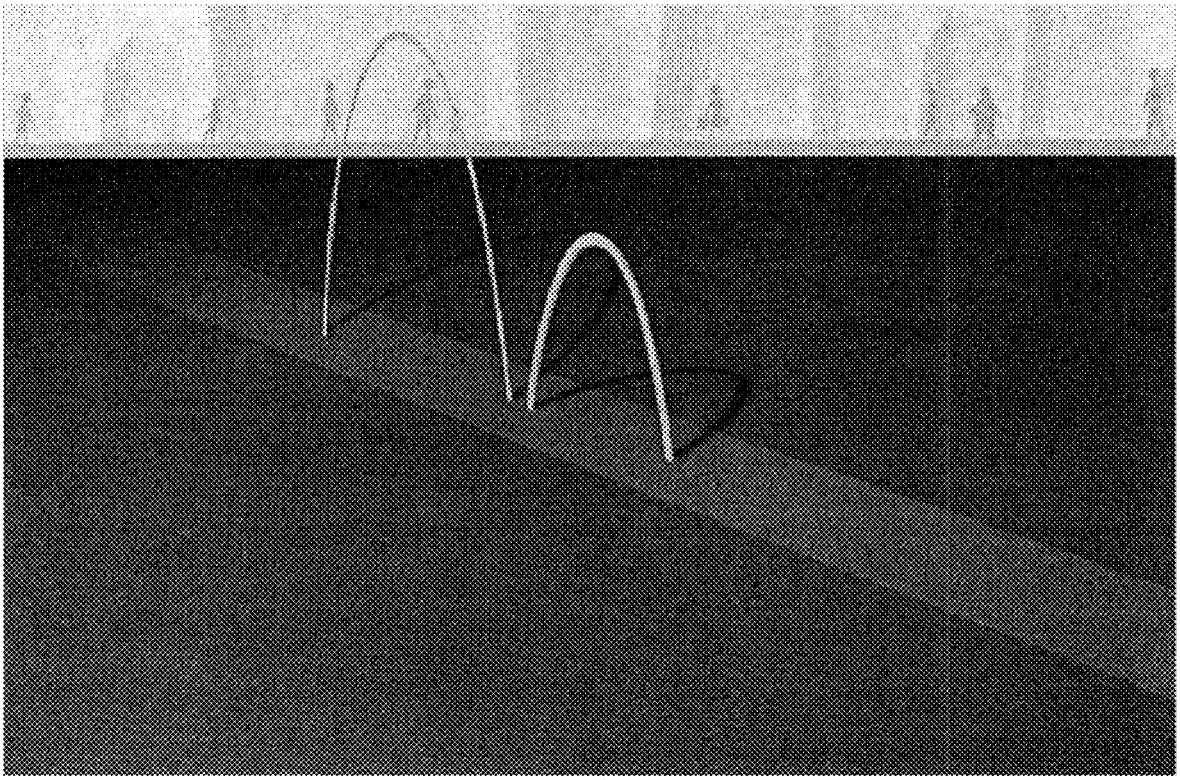
Figure 9A:
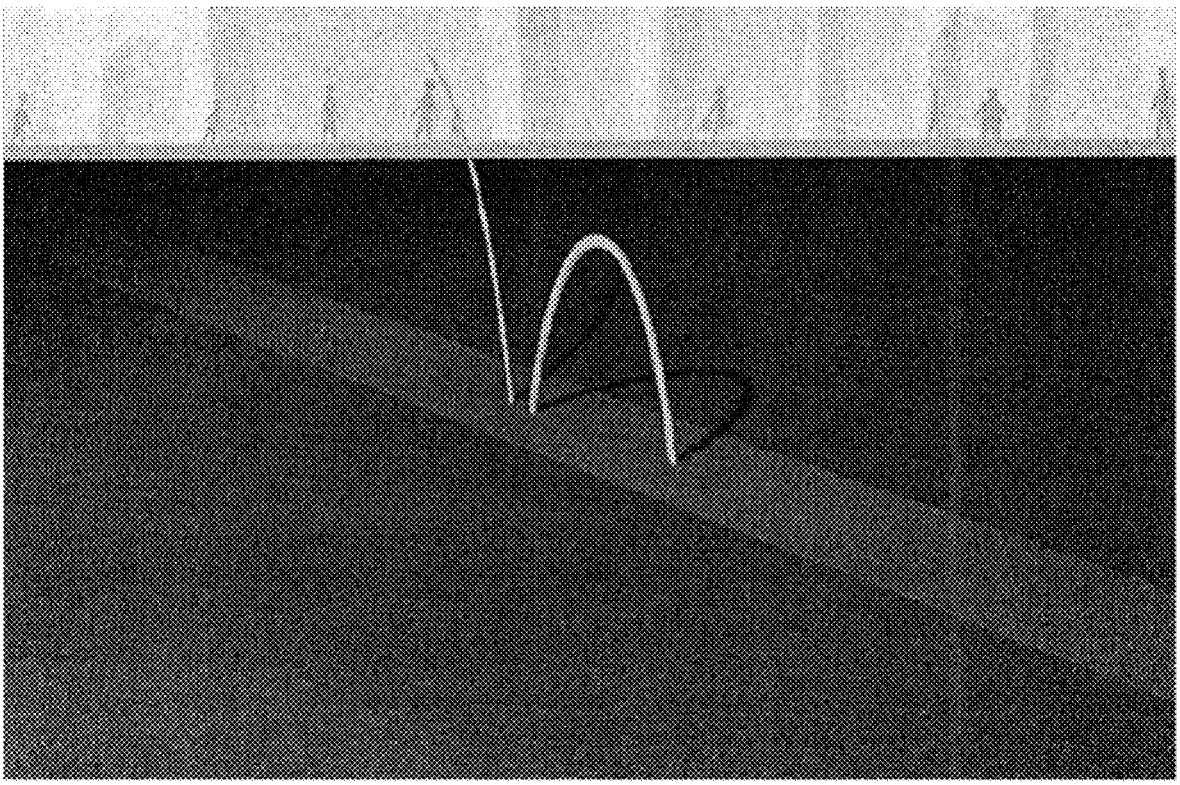
FIGS. 9A-9D show two parabolic water streams appearing to step over one another.
Figure 9B:
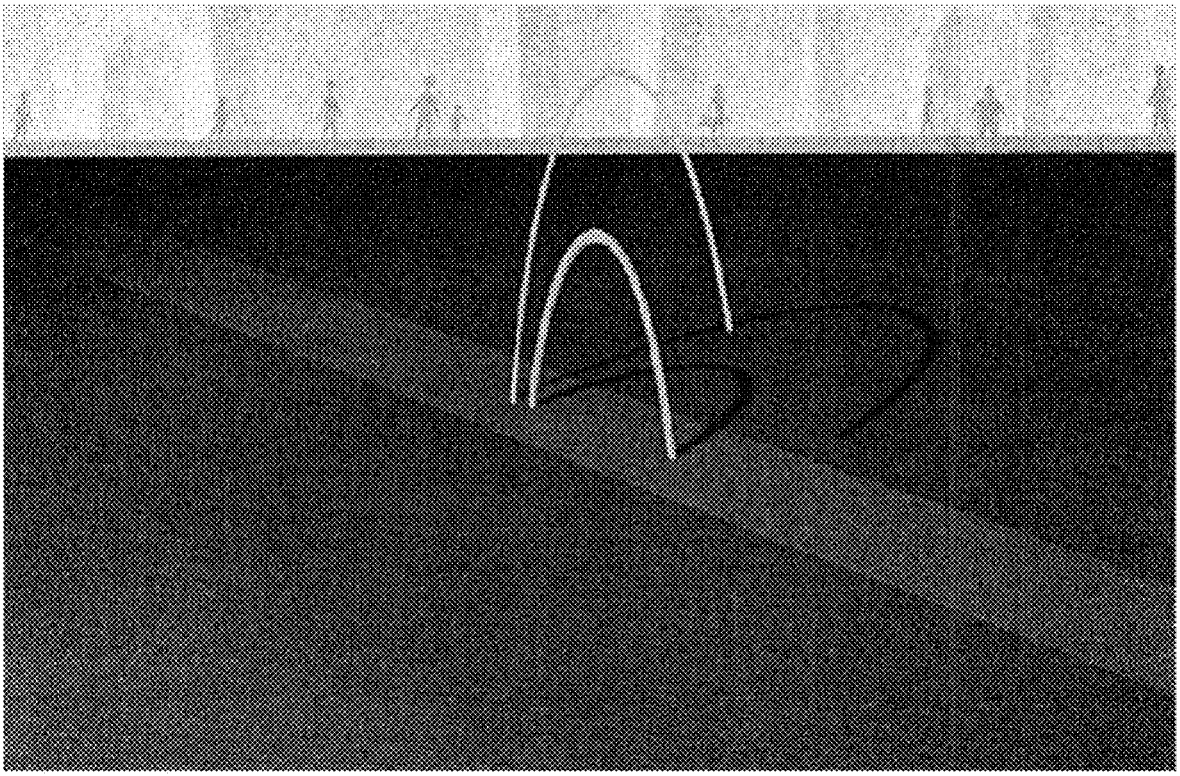
Figure 9C:
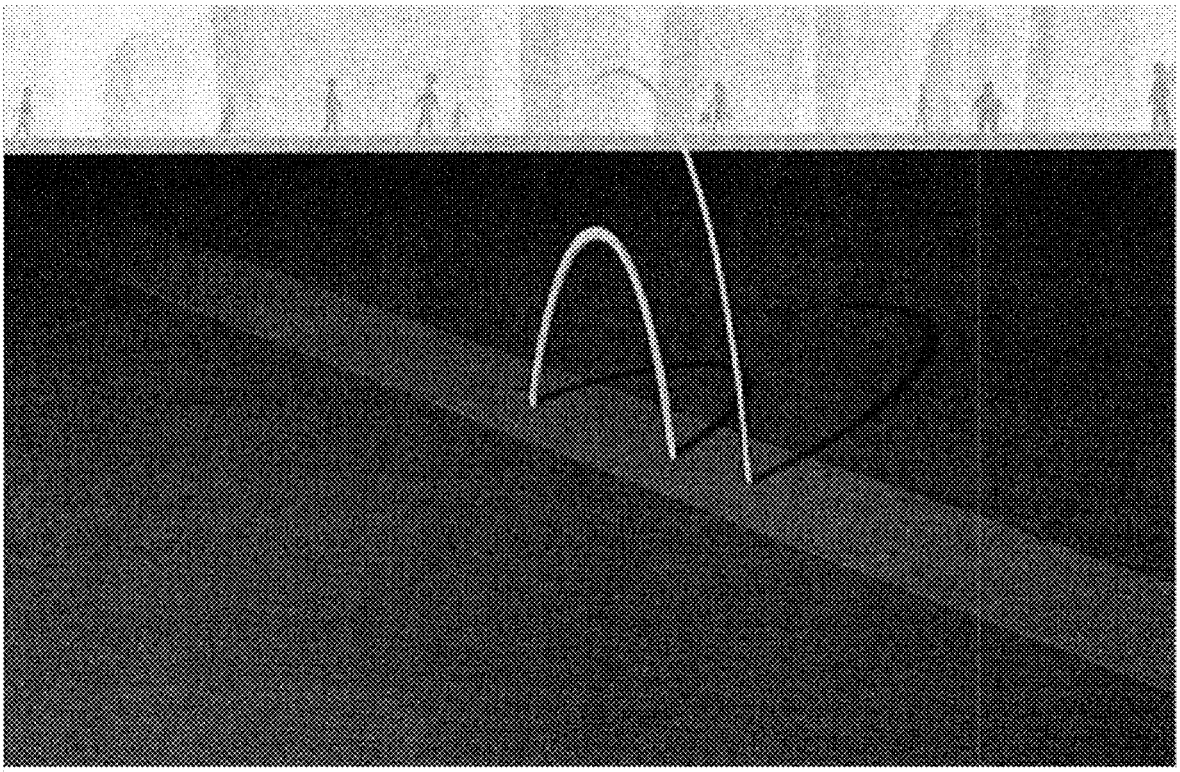
Figure 9D:
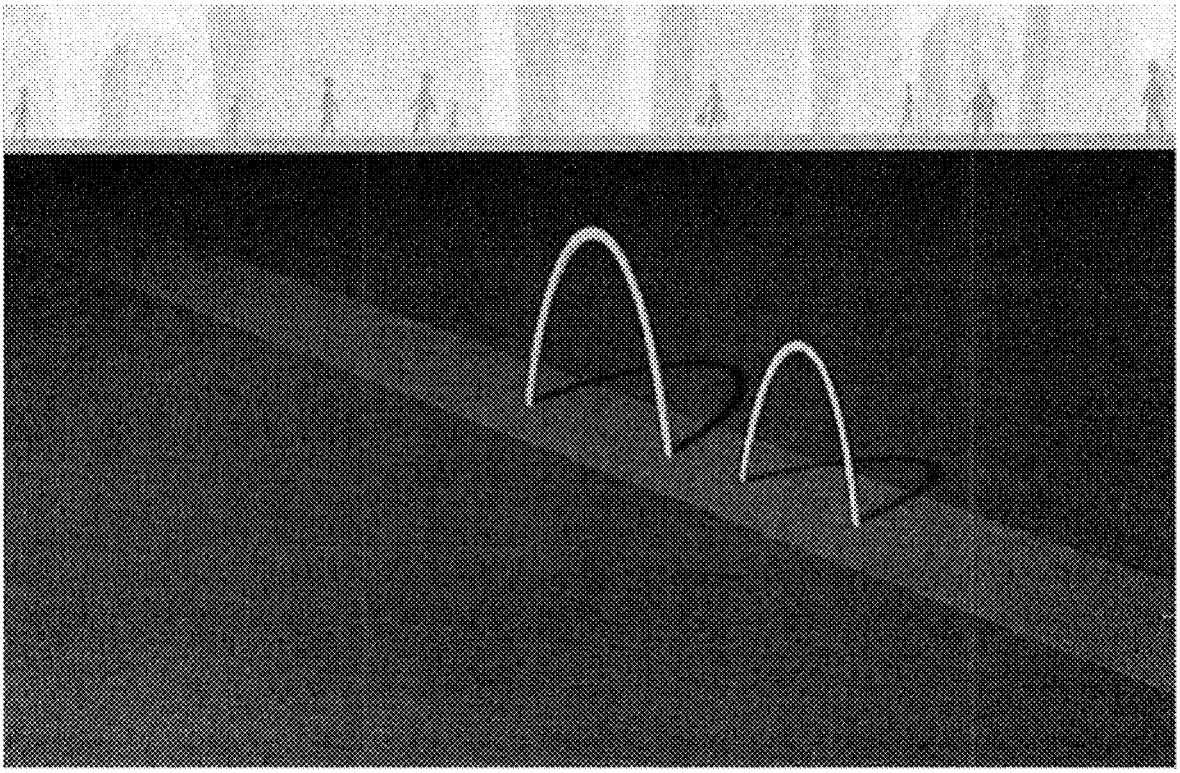

Continuing on, FIG. 7E depicts water shooter 20*c* in the moment of time slightly after is has opened its stream interrupter (not shown) such that parabolic water stream 50*c* may be emitted from water shooter 20*c*. As shown, it may be preferable that the water stream 50*c* is directed away from water stream 50*a*. The emission of water stream 50*c* from water shooter 20*c* in this direction may emulate the next step taken by water stream 50*b*, 50*c* after it has "stepped over" water stream 50*a*. That is, as viewed from above the floor 40, and because the water shooters 20*a*, 20*b*, 20*c* may be out of view, water stream 50*b* may appear to step over water stream 50*a*, and then may appear to continue to step away from water stream 50*a*. However, the water stream that is continuing to step away from water stream 50*a* may not be water stream 50*b* but may be water stream 50*c*.

It should be noted that system 10 may perform the walking sequence and the stepping over one another sequence in various combinations and with various water shooters. For example, two water shooters may perform a choreographed walking sequence with each other, and then one of the streams may perform the stepping over one another sequence over the other shooter.

Given that shooters 20*b*, 20*a*, 20*c* are all positioned on track 30, and given that one would expect that one shooter would simply not be able to walk over another shooter, the visual display provided by the "stepped over" sequence is counterintuitive and entertaining.

Referring now to FIGS. 8A-8D, two parabolic streams are seen walking toward each other as described above. FIGS. 9A-9D show the "stepping over" sequence described above.

It may be preferable that the various attributes and settings of a water shooter 20 of system 10 such as the input water pressure, the launch angle Ø of rotating mount 28, the engagement of the stream interrupter, the position of the water shooter 20 on the track 60 and other settings be controlled remotely by a computer or other controller. The controller may run software programs that allow fully automate the various settings described above to achieve a desired water display. The software may also allow for the manual control of the settings, or for a hybrid combination of automated and manual control of the setting.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A system for providing a water display, the system comprising:

a reservoir that contains water;

a guide; and two or more movable water delivery devices that are configured within the reservoir, that are movably mounted to the guide, that are movable along the guide separately from each other and that produce water streams, with each water stream having a launch angle with a vertical component;

an upper floor configured above the two or more movable water delivery devices; and a slot in the upper floor positioned to coincide with the guide;

wherein each of the two or more movable water delivery devices has a variable input water pressure and includes a movable nozzle that is configured to change the vertical component of the launch angle of its water stream; and, wherein each of the two or more movable water delivery devices emits its water stream through the slot.

2. The system of claim 1, comprising a total of three movable water delivery devices each having a movable nozzle that emits a parabolic water stream having a variable height or width, and wherein the emitted parabolic water streams are controlled to provide a water display wherein one parabolic stream appears to jump over another parabolic stream.

3. The system of claim 1, wherein the guide comprises at least one track upon which the two or more movable water delivery devices are moveably mounted.

4. The system of claim 1, wherein each of the movable nozzles is pivotably mounted to its movable water delivery device.

5. The system of claim 1, wherein the two or more movable water delivery devices and the movable nozzles are movable by a remote control.

6. The system of claim 1, further comprising a stream interrupter for interrupting the streams of water produced by the two or more movable water delivery devices.

7. A system for providing a water display, the system comprising:

a reservoir that contains water;

a guide; and two or more movable water delivery devices that are configured within the reservoir, that are movably mounted to the guide, that are movable along the guide separately from each other and that produce water streams, with each water stream having a launch angle with a vertical component;

an upper floor configured above at least one of the two or more movable water delivery devices; and a slot in the upper floor positioned to coincide with the guide;

wherein the at least one of the two or more movable water delivery devices has a variable input water pressure and includes a movable nozzle that is configured to change the vertical component of the launch angle of its water stream; and wherein the at least one of the two or more movable water delivery devices emits its water stream through the slot.

8. The system of claim 7, wherein the water streams are each parabolic, and each has a starting point and an ending point, and each has a height and a width that are controlled by varying the input water pressure and/or the vertical component of the launch angle.

9. The system of claim 8, wherein the second, third, fourth, etc., of the two or more movable water delivery devices each includes a movable nozzle that is configured to change the direction of its water stream, and wherein each movable nozzle emits a parabolic water stream having a variable height or width, and wherein the parabolic water streams are controlled to provide the appearance that they are moving towards or away from each other.

10. The system of claim 8, wherein the ending point has a first position and a second position; and wherein the height of the parabolic stream is held constant by varying the input water pressure and the vertical component of the launch angle while the ending point is moved from the first position to the second position.

11. The system of claim 10, wherein the at least one of the two or more movable water delivery devices has a first position and a second position along the guide; and wherein the height of the parabolic stream is held constant by varying the input water pressure and the vertical component of the launch angle while the at least one of the two or more movable water delivery devices moves from the first position to the second position.

* * * * *